US005636598A

United States Patent [19]

Moore, Jr.

[11] Patent Number: 5,636,598

[45] Date of Patent: Jun. 10, 1997

[54] INDUCED DRAFT COMBUSTION WATER HEATER

[75] Inventor: H. Jack Moore, Jr., Playa Del Rey, Calif.

[73] Assignee: Sabh (U.S.) Water Heater Group, Inc., Bala Cynwyd, Pa.

[21] Appl. No.: 641,710

[22] Filed: May 2, 1996

Related U.S. Application Data

[63] Continuation of Ser. No. 333,870, Nov. 3, 1994, abandoned, which is a continuation of Ser. No. 160,929, Dec. 1, 1993, abandoned.

[51] Int. Cl.[6] ..... F22B 9/04

[52] U.S. Cl. ..... 122/17; 126/351; 110/162

[58] Field of Search ..... 122/15–17; 126/351; 110/162

[56] References Cited

U.S. PATENT DOCUMENTS

| | | | |
|---|---|---|---|
| 1,643,859 | 9/1927 | Sauvage | 110/162 |
| 4,203,392 | 5/1980 | McLane | 122/17 |
| 4,205,631 | 6/1980 | Parker | 110/162 |
| 4,402,303 | 9/1983 | Koenneman | 110/162 |
| 4,541,410 | 9/1985 | Jatana | 122/17 |
| 4,672,919 | 6/1987 | Staats | 122/17 |
| 4,712,515 | 12/1987 | Couprie | 122/17 |
| 4,742,800 | 5/1988 | Eising | 122/17 |
| 4,766,883 | 8/1988 | Cameron et al. | 122/17 |
| 4,787,842 | 11/1988 | Stewart et al. | 110/162 |
| 4,789,330 | 12/1988 | Ballard et al. | 110/162 |
| 4,856,982 | 8/1989 | Olson | 431/20 |
| 4,943,209 | 7/1990 | Beehler | 416/204 R |
| 5,022,352 | 6/1991 | Osborne et al. | 122/17 |
| 5,085,579 | 2/1992 | Moore, Jr. et al. | 126/351 |
| 5,115,798 | 5/1992 | Moore, Jr. et al. | 126/351 |
| 5,179,914 | 1/1993 | Moore, Jr. et al. | 122/17 |

*Primary Examiner*—Andrew M. Dolinar
*Attorney, Agent, or Firm*—Miller & Christenbury

[57] ABSTRACT

A water heater includes a tank and an exhaust blower is located below the tank and connected to the exhaust line to draw the combustion products by suction through the coil-shaped heat exchanger, through the combustion gases conduit and through the combustion chamber and to draw fuel and air into the burner through the inlet conduit.

17 Claims, 2 Drawing Sheets

INDUCED DRAFT COMBUSTION WATER HEATER

This application is a continuation of application Ser. No. 08/333,870, filed Nov. 3, 1994, now abandoned, which is a continuation of application Ser. No. 08/160,929, filed Dec. 1, 1993, now abandoned.

BACKGROUND OF THE INVENTION

This invention relates to a heater, and more particularly to a water heater for domestic or industrial use. More specifically, the invention relates to a water heater of the fuel burning type, and more particularly to a gas water heater. The invention more particularly relates to a water heater that provides a novel and advantageous way of handling products of combustion of the fuel that is used, especially the effective and efficient removal of condensate therefrom. The invention further relates to a highly advantageous and more economical apparatus for causing the flow of air and fuel into the burner that provides the energy for the water heater, and through exhaust tubes for handling the combustion gases resulting from the burning of the fuel.

It is well known in the art to provide a water heater with a gas burner and with a convoluted exhaust gas exit tube which is immersed in the water contained in the water heater tank and which transfers heat into the water. Such a water heater is disclosed, for example, in the patent issued to Mor-Flo Industries, Inc., U.S. Pat. No. 5,022,352, granted Jun. 11, 1991. Such a water heater is provided with a blower just beneath the burner, arranged for introducing a combination of air and fuel into the burner under positive pressure in order to provide the combustion that is necessary to generate the heat for heating the water. Such an apparatus is widely known for its effective and reliable use. The blower provided in commercial water heaters embodying the features of the aforementioned Mor-Flo patent, has necessarily been constructed of relatively expensive fire-resistant metals and materials. Although such blowers are relatively expensive, their use is necessary and important because they need to provide resistance to the high temperatures resulting from an occasional backfire of the blower back through the blower.

In many fuel-fired water heaters considerable condensate is formed in the exhaust gas tubes of the water heater, and means must be provided at the exhaust gas exit from the water heater to separate the condensate from the exhaust gases and to handle or otherwise dispose of the condensate. This, too, requires additional expense in the manufacture of the water heater and its subsequent maintenance.

OBJECTS OF THE INVENTION

It is accordingly an object of this invention to provide an improved water heater of the fuel-fired type that is capable of operating effectively, efficiently and safely with a much less expensive burner.

Still another object of this invention is to provide such a water heater having the capability of readily handling the condensate from the exhaust gases without requiring an expensive and complicated condensate trap and the pipes and fittings necessarily associated therewith.

Other objects and advantages of this invention, and the means by which they may be accomplished, will be apparent hereinafter, and in the drawings of which:

DETAILED DESCRIPTION OF THE PREFERRED EMBODIMENT

Figure 1:
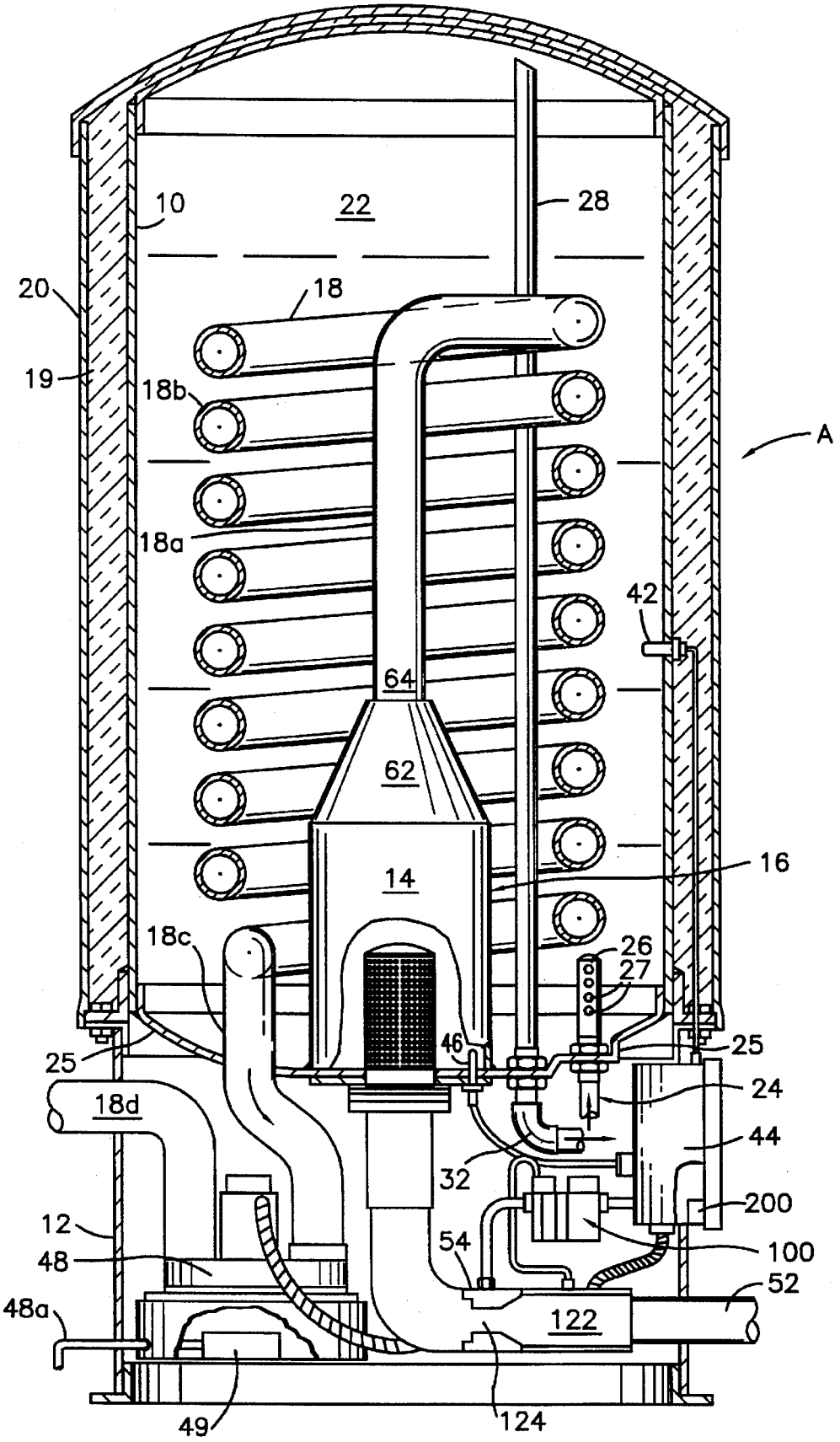
FIG. 1 is a side elevation of a water heater utilizing features of this invention. The drawing in FIG. 1 is partially broken away in order to show important components of the water heater.

Referring now to the drawings, which are intended to illustrate a preferred embodiment of the invention only, and are not intended to limit the scope of the invention, the figures show a water heater A comprised of a water containing tank 10 supported upon a base 12 and containing a combustion chamber 14 surrounded by a combustion chamber wall 16 and an exhaust gas exit tube 18. The water containing tank 10 is surrounded by a layer of insulation 19 and a protective jacket 20 in the conventional manner.

The tank 10 is filled with a stratified body of water 22 with the coldest water remaining in the bottom of the tank and the hottest water rising to the top. The water to be heated is introduced into the water containing tank 10 through inlet piping 24 leading through the bottom plate 25 of the tank and feeding water to an inlet water diffuser 26. The diffuser 26 is a short, closed tube having apertures 27 along one of its side surfaces which introduces water into the tank 10 near its bottom.

Heated water is withdrawn from the tank 10 through an outlet tube 28 which is fixed to a fitting penetrating through the bottom plate 25 of the tank 10 and extends upwardly to the topmost region of the tank 10. The top of outlet tube 28 is open. Heated water passes through this opening into the tube, downwardly through the outlet tube, out of the tank 10 and into the outlet hot water piping 32.

Inlet piping 24 and outlet hot water piping 32 are connected to the domestic water piping of the building in which the heater is disposed thereby supplying hot water. The inlet piping 24 and outlet hot water piping 32 may also be connected through appropriate valves to a heat exchanger in the space heating and ventilating system to provide heat for the building in accordance with the teachings of Jatana U.S. Pat. No. 4,451,410.

When hot water is withdrawn from the tank 10 through the outlet tube 28, additional cold water is drawn into the tank 10 through the inlet water diffuser 26. When sufficient cold water is drawn into the tank 10, the drop in water temperature is sensed by a water temperature sensor 42. The water temperature sensor 42 is connected to the electric control circuitry contained in an electrical control box 44. Appropriate control circuitry is well known in the art and will not be described in detail herein.

Figure 2:
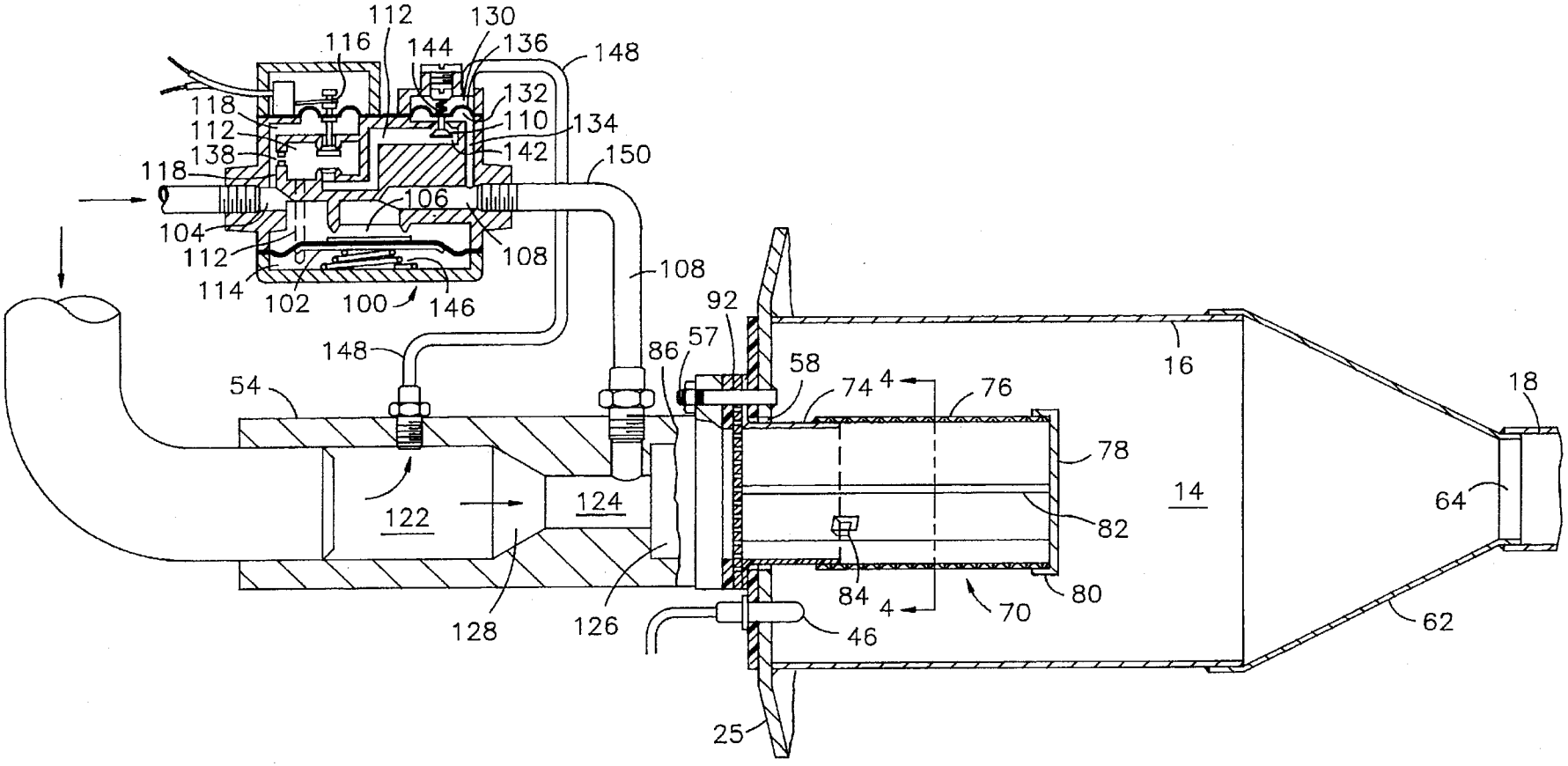
FIG. 2 is a side elevation of a lower portion of the water heater of FIG. 1, showing a negative pressure gas valve and the manner in which it is associated with other components at the inlet of the water heater.

In response to the lowered water temperature within the tank 10, an electric ignitor 46 in combustion chamber 14 is turned on. The ignitor quickly reaches a temperature sufficiently high to ignite a gas and fuel mixture. Similarly, in response to increased water temperature within tank 10, electric ignitor 46 is turned off, which results in shut-down burner 70. In accordance with this invention, a blower 48 is connected downstream of the exhaust gas exit tube 18, through connecting pipe **18*c* and sucks the combustion products out of the combustion zone 14. In response to the ignitor 46, the blower 48 is energized and a fuel regulator 100 is turned on. The blower 48 draws air from combustion chamber 14 and through venturi 124 and from outside the building or vehicle through air inlet tubing 52 into an air and fuel proportioner 54 where fuel is introduced to the airstream and some mixing occurs. The air and fuel proportioner is shown in FIG. 2 and is described in detail hereafter. The air and fuel is drawn directly into the combustion chamber 14**.

The blower 48 is located downstream of the exhaust gas exit tube. This is important as all points in the system at which leaks may develop are maintained at less than atmospheric pressure during burner operation. If a leak should develop, such a leak would result in a minor addition of air to the air and fuel mixture rather than fuel escaping from the blower.

The pressurized combustion products from the blower 48 are directed through the output conduit 18*d* and to the atmosphere.

The combustion chamber 14 is contained within a cylindrical combustion chamber wall 16 which is welded around its lower periphery to the bottom plate 25 of water containing tank 10. The top of the combustion chamber 14 is defined by a conical combustion chamber top 62 which is welded to the top of the combustion chamber wall 16. The combustion chamber top 62 is provided with an exhaust aperture 64 which communicates with the exhaust gas exit tube 18. The exhaust gas exit tube 18 is welded to the topmost portion of the combustion chamber top 62. The exhaust gas exit tube 18 is comprised of a short vertical segment 18*a* leading upwardly from the combustion chamber and a helical segment 18*b* spiralling downwardly within the water containing tank 10. The lower end 18*c* of the exhaust gas exit tube exits the tank 10 through the tank bottom plate 25 and is connected to the inlet of blower 48.

As seen in FIG. 1, the exhaust gas exit tube 18 conveys the exhaust gases on a helically downwardly spiralling path through the body of water 22 and hence outside of the water containing tank 10 and outside of the building or vehicle in which the heater A is located. Throughout the entire path of air and fuel and combustion gases, the blower 48 has applied negative pressure to the combustion exhaust gases, drawing the exhaust gases along the convoluted and lengthy heat exchange path described above, with highly efficient heat exchange throughout.

Turning now to FIG. 2 of the drawings, proportioning is accomplished in the air and fuel proportioner 54 (best seen in FIG. 2) which is positioned in the air stream just prior to burner 70, which is the inlet side of the water heater. A gas pressure servo regulator 100, known per se and available from Robertshaw Controls Co. and others, operates in concert with the air and fuel proportioner 54.

The positioning of the air and fuel proportioner 54 on the inlet side of the water heater A, remote from the blower 48, is important. In the past, it has been suggested to use an air and fuel proportioner to mix fuel with air after the air has been pressurized in a blower. Such an arrangement can result in incomplete mixing of the air and fuel. There can be rich parts and lean parts in the flow. While an elaborate proportioner design could be made to mix better, the present invention allows the use of a less complex proportioner. Moreover, placing the proportioner 54 on the inlet side of the blower 48 with a negative pressure gas valve allows the proportioner 54 to operate correctly with almost any fuel supply pressure.

The possibility of dangerous leaks of fuel to the atmosphere is reduced or entirely eliminated when the air and fuel proportioner performs its function at less than atmospheric pressure. With the air and fuel proportioner 54 on the inlet side of the water heater A, the pressure in the air and fuel proportioner 54 is maintained at less than atmospheric pressure by the suction the blower 48 applies downstream of the body of the water heater. A leak may result in a minor addition of air to the air and fuel mixture. If the blower 48 were located on the input side of the water heater, pressures in the air and fuel proportioner would be higher than atmospheric and leaks might result in fuel entering the atmosphere around the heater A.

The gas pressure servo regulator 100 is somewhat conventional per se, but interacts with the negative pressure air and fuel proportioner 54 in a novel manner. The negative pressure servo regulator 100 is comprised of a main valve diaphragm 102 which controls the flow of gas from the servo regulator gas input 104 through a main valve aperture 106 to the servo regulator output 108. A negative pressure sensing regulator valve 110 regulates a small control flow from a main bleed line 112 connected to a main valve control chamber 114 below the main valve diaphragm 102. Gas flows into the main bleed line 118 and the main valve control chamber 114 from the gas input 104 through a bypass line 118 and a small orifice 138. An electrically controlled two position operator valve 116 opens the main bleed line 112 in the "on" position and closes the main bleed line 112 and connects the main valve control chamber 114 to the bypass line 118 in the "off" position.

The air and fuel proportioner 54 is comprised of an air inlet section 122 having a fixed diameter, a venturi throat section 124 of a diameter smaller than the diameter of the air inlet section and an exit section 126 of a diameter larger than the venturi throat section diameter. The air inlet section 122 and the venturi throat section 124 are interconnected by a tapered section 128 providing a smooth transition between these two sections.

The specific details of operation of the air and fuel proportioner 54 are considered to be well known in the art, and further details in respect of its operation are believed to be unnecessary for an understanding of the present invention. However, such further details appear in the specification of the Cameron and Moore U.S. Pat. No. 4,766,883, granted Aug. 30, 1988, the disclosure of which is incorporated herein by reference.

It will accordingly be appreciated that great advantages are achieved in accordance with this invention by providing the blower 48 in a downstream position with respect to the combustion products tubing contained in the water heater, thereby sucking the combustion gases under negative pressure through and from within the water heater, and by applying suction even to the combustion chamber 14 and to the inlet pipes 122 and 52. This enables the utilization of a much less expensive exhaust blower which may be formed of plastic materials without fear of exposure to heat or damage due to backfires. Further, with the exhaust blower in the downstream position as illustrated in the drawings, the blower itself takes the place of a separate and complicated condensate trap since the blower inherently separates the condensed liquid from the gases and pumps the liquid out of the drain pipe. The fact that the condensate exhaust tubing is convoluted and has considerable total length within the water contained in the tank provides excellent heat exchange with the water, resulting in particularly low temperature condensate maintained at negative pressure. This allows the use of low temperature materials in the construction of the exhaust blower. Indeed, very inexpensive exhaust blowers may be used, made largely of inexpensive plastic components, without fear of overheating, either from the heat of the combustion zone or even the small amount of residual heat contained in the combustion products.

Although a separate condensate pump 49 may be provided in association with the exhaust blower 48, to pump the condensate through pipe 48*a* to some remote location for further processing, the use of a separate condensate pump 49 is not a necessary feature in accordance with this invention.

It is important to this invention that the thermal efficiency of the water heater is so great as to produce a particularly low temperature exhaust gas, thus simplifying the handling of the exhaust gas and expediting its separation from the accompanying condensate.

It is also possible in accordance with this invention to pre-purge the entire system by running and controlling the blower 48 with a timer 200 for a period of time before the burner is actuated, and it is also possible to post-purge the system by running and controlling the blower 48 with a timer 200 after the supply of fuel to the burner has been cut off. The use of ordinary and known timers and control systems for these purposes is well known per se in the art.

Although this invention has been described with reference to particular embodiments thereof, it will be appreciated that many variations may be made without departing from the spirit or scope of the invention. All such variations, including reversals of parts, use of certain features independently of other features, and the substitution of equivalent elements for those particularly shown in the drawings, are intended to be included within the scope of the invention as defined in the appended claims.

What is claimed is:

1. In a water heater comprising a tank, a fuel burner, an inlet conduit connected to said burner, a combustion chamber located within said tank for containing hot combustion gases from said fuel burner, a convoluted combustion products heat exchanger conduit connected to said combustion chamber and extending downwardly in said tank and through an outlet located at a lower portion of said tank to cool the hot combustion gases and transfer heat to the water in said tank, wherein condensate is formed as a result of said cooling of said hot combustion gases, the combination which comprises:

(a) a generally upright exhaust line connected to said outlet to receive the resulting cooled exhaust gases and condensate from said heat exchanger, and (b) an exhaust blower located below said tank and being continuously operative during fuel combustion, said exhaust blower connected to said generally upright exhaust line for creating negative pressure by drawing said combustion products by suction through said heat exchanger, through said combustion gases conduit and through said combustion chamber and positioned to draw combustion air into said burner through said inlet conduit.

2. The water heater defined in claim 1, wherein said exhaust blower and exhaust line are positioned at an effective distance below said tank to separate condensate from the cooled combustion gases, and wherein means are provided for removal of said condensate from said cooled combustion gases.

3. The water heater defined in claim 2, wherein a condensate drain pipe is connected below said exhaust blower to remove said condensate from the water heater.

4. The water heater defined in claim 1, wherein said exhaust blower comprises a plastic material of low-temperature tolerance which has capacity to maintain its structural integrity when exposed to said cooled combustion gases but does not have capacity to maintain its structural integrity in the presence of said hot combustion gases.

5. The water heater defined in claim 1, further comprising an ignition means for igniting said burner in response to decreased water temperature in said tank and a timing means for actuating said blower prior to the igniting of said burner to thereby purge gases from said inlet conduit, said combustion chamber, said combustion gases conduit, said heat exchanger conduit and said outlet.

6. The water heater defined in claim 1, further comprising an inactivating means for inactivating said burner in response to increased water temperature in said tank and a timing means for continuing to actuate said blower subsequent to inactivation of said burner to thereby purge gases from said inlet conduit, said combustion chamber, said combustion gases conduit, said heat exchanger conduit and said outlet.

7. The water heater defined in claim 1, further comprising an ignition means for igniting said burner in response to decreased water temperature in said tank, an inactivating means for inactivating said burner in response to increased water temperature in said tank, and a timing means for actuating said blower prior to ignition of said burner and for continuing to actuate said blower subsequent to inactivation of said burner, to thereby purge gases from said inlet conduit, said combustion chamber, said combustion gases conduit, said heat exchanger conduit and said outlet.

8. The water heater defined in claim 1, wherein a venturi is provided in said inlet conduit.

9. The water heater defined in claim 1, further comprising an air and fuel proportioner on the inlet side of said water heater.

10. The water heater defined in claim 1 wherein said exhaust blower separates condensate from said cooled exhaust gases and pumps the condensate outwardly of the water heater.

11. In a water heater comprising a tank, a fuel burner, an inlet conduit connected for introducing fuel and air into said burner, a combustion chamber located within said tank for containing hot combustion gases from said fuel burner, a hot combustion gases conduit extending upwardly in said tank from said combustion chamber, a convoluted combustion products heat exchanger conduit connected to said combustion gases conduit and extending downwardly in said tank and through an outlet located at a lower portion of said tank to cool the hot combustion gases and transfer heat to the water in said tank, wherein condensate is formed as a result of said cooling of said hot combustion gases, the combination which comprises:

(a) an exhaust line connected to receive the resulting cooled exhaust gases and condensate from said heat exchanger, and (b) an exhaust blower located below said tank and continuously operative during fuel combustion, said exhaust blower connected to said exhaust line for creating negative pressure by drawing said combustion gases by suction through said heat exchanger, through said combustion gases conduit and through said combustion chamber and to draw said fuel and air into said burner through said inlet conduit means, wherein said exhaust blower and exhaust line are positioned at an effective distance below said tank to separate condensate from the cooled combustion gases, and wherein means are provided for removal of said condensate from said cooled combustion gases, said removal means being connected below said exhaust blower to remove said condensate from the water heater and including a pump connected to said removal means to pump said condensate.

12. A water heater comprising: a water tank, a burner, an inlet conduit connected to said burner, a combustion chamber located within said tank, a convoluted combustion products heat exchanger conduit connected to said combustion chamber and extending downwardly in said tank and through an outlet located at a lower portion of said tank, a generally upright exhaust line connected to said outlet to receive resulting cooled exhaust gases and condensate from said heat exchanger conduit, and an exhaust blower located below said tank and being continuously operative during fuel combustion, said exhaust blower connected to said generally upright exhaust line for creating negative pressure by drawing said exhaust gases by suction through said heat exchanger conduit and said combustion chamber.

13. The water heater defined in claim 12 wherein said exhaust blower separates condensate from said cooled exhaust gases and pumps the condensate outwardly of the water heater.

14. A water heater comprising a housing, a water tank positioned above said housing, a burner, an inlet conduit connected to said burner, a combustion chamber located within said tank, a convoluted combustion products heat exchanger conduit connected to said combustion chamber and extending downwardly in said tank and through an outlet located at a lower portion of said tank, an exhaust line connected to said outlet to receive resulting cooled exhaust gases and condensate from said heat exchanger conduit, and an exhaust blower located within said housing and below said tank and continuously operative during fuel combustion, said exhaust blower connected to said exhaust line for creating negative pressure by drawing said exhaust gases by suction through said heat exchanger conduit and said combustion chamber.

15. The water heater defined in claim 14 wherein said exhaust blower separates condensate from said cooled exhaust gases and pumps the condensate outwardly of the water heater.

16. A water heater comprising a water tank, a burner, an inlet conduit connected to said burner, a combustion chamber located within said tank, a convoluted combustion products heat exchanger conduit connected to said combustion chamber and extending downwardly in said tank and through an outlet located at a lower portion of said tank, an exhaust line connected to said outlet to receive resulting cooled exhaust gases and condensate from said heat exchanger conduit, and an exhaust blower located below and laterally within the periphery of said tank and being continuously operative during fuel combustion, said exhaust blower connected to said exhaust line for creating negative pressure by drawing said exhaust gases by suction through said heat exchanger conduit and said combustion chamber.

17. The water heater defined in claim 16 wherein said exhaust blower separates condensate from said cooled exhaust gases and pumps the condensate outwardly of the water heater.

* * * * *